US007200540B2

(12) United States Patent
Colvin et al.

(10) Patent No.: US 7,200,540 B2
(45) Date of Patent: Apr. 3, 2007

(54) SYSTEM AND METHOD FOR AUTOMATED PLATFORM GENERATION

(75) Inventors: Richard Daniel Colvin, Dripping Springs, TX (US); Glenn Robert McColpin, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 0 days.

(21) Appl. No.: 10/623,347

(22) Filed: Jul. 18, 2003

(65) Prior Publication Data

US 2004/0153299 A1 Aug. 5, 2004

Related U.S. Application Data

(60) Provisional application No. 60/444,281, filed on Jan. 31, 2003.

(51) Int. Cl.
*G06F 9/455* (2006.01)

(52) U.S. Cl. ..... 703/10; 702/6; 702/9; 702/12; 166/387; 166/312; 166/356; 166/350

(58) Field of Classification Search ..... 703/10; 702/6, 12, 9; 166/387, 250, 312, 250.021, 166/356, 350, 250.01; 175/40
See application file for complete search history.

(56) References Cited

U.S. PATENT DOCUMENTS 5,398,762 A * 3/1995 Stinessen ..... 166/356
5,517,428 A 5/1996 Williams ..... 703/1
5,740,342 A 4/1998 Kocberber ..... 395/120
5,757,663 A * 5/1998 Lo et al. ..... 702/6
5,762,149 A * 6/1998 Donovan et al. ..... 175/40
5,844,799 A 12/1998 Joseph et al. ..... 702/2
5,975,207 A * 11/1999 Smitherman ..... 166/312
6,006,832 A * 12/1999 Tubei et al. ..... 166/250.021
6,021,377 A * 2/2000 Dubinsky et al. ..... 702/9
6,236,894 B1 5/2001 Stoisits et al. ..... 700/28
6,315,054 B1 * 11/2001 Brunet ..... 166/387
6,549,879 B1 * 4/2003 Cullick et al. ..... 703/10
6,873,267 B1 * 3/2005 Tubel et al. ..... 340/853.3
2002/0165671 A1 * 11/2002 Middya ..... 702/12
2003/0047308 A1 * 3/2003 Hirsch et al. ..... 166/250.15
2003/0150618 A1 * 8/2003 Nish et al. ..... 166/350
2003/0204311 A1 10/2003 Bush ..... 702/13
2005/0149307 A1 * 7/2005 Gurpinar et al. ..... 703/10

OTHER PUBLICATIONS

Devine et al., "Models for the minimum cost development of offshore oil fields", Management Science, Apr. 1972.*
Iyer et al., "Optimal planning and scheduling of offshore oil field infrastructure investment and operations", Ind. Eng. Chem. Res, 1998.*
Johnson et al., "Improving gas storage development planning through simulation-optimization", 2000 Society of Petroleum Engineers Eastern Regional Meeting, Oct. 2000.*
Johnson et al., "Using artificial neural networks and genetic algorithm to optimize well-field design: Phase I final report", Lawrence Livermore National Laboratory, Mar. 1998.*

* cited by examiner

*Primary Examiner*—Kandasamy Thangavelu
(74) *Attorney, Agent, or Firm*—Merchant & Gould

(57) ABSTRACT

Systems for implementing methods for generating platform location sets comprising selecting a set of platform locations; determining additional platform locations to add to the set of platform locations; validating the additional platform locations, and determining an optimum location for each platform location in the set of platform locations.

6 Claims, 13 Drawing Sheets

SYSTEM AND METHOD FOR AUTOMATED PLATFORM GENERATION

RELATED APPLICATIONS

This application claims priority to U.S. Provisional Application Ser. No. 60/444,281, filed on Jan. 31, 2003, which is incorporated herein by reference.

FIELD OF THE INVENTION

The invention relates generally to methods for reducing the time and/or cost associated with extraction of hydrocarbons from underground reservoirs. More specifically, the present invention relates to systems and methods for automating the generation of wellpath plans and the resulting platform locations from selected well targets.

BACKGROUND OF THE INVENTION

One method for determining platform placement that is most often used may be thought of as a "move and calculate footage" based method. In this method, a series of wellpath plans are created manually, one at a time, using dogleg, inclination, reach, and anti-collision as the planning criteria for the platform location. The cumulative measured depth traversed by the many wellpaths is summed and used as a measurement of the base case location.

Once the wellpaths are created, the well planner then moves the surface location of the base case platform a fixed distance, usually in one of the four compass directions, and recalculates the cumulative measured depth. If the cumulative measured depth decreases from the base case measurement, the well planner knows that there is a potential location which is "better" than the base case location. The planner then goes through many iterations moving the platform location by different distances and to different compass directions from the base case location looking for the best location based on the total calculated footage of the wellpaths that will be required to drill from the wells to the platform location.

The above-mentioned methodology has a number of drawbacks. For example, it is tedious, time consuming, and requires fixing the number of plans and targets to be reached. Using this methodology, it is not unusual for well planners to spend three to four weeks on one project.

Other automated methods for platform placement use Monte-Carlo or random number based statistical calculations for platform placement and take into account producers vs. injectors, cost of processing facilities, and existing pipelines. They, however, do not take into account target weighting, and may also not re-allocate the number of targets to find a better platform placement solution.

Therefore, there is a need for an automated method which varies the number and locations of Platforms as well as optimizes the targets used if the resultant platform set provides a plan that: a) reaches more targets; b) reaches the same number of targets with less distance; or c) reaches the same number of targets, but includes targets with higher weighting values based on the reservoir parameters.

Embodiments of the present invention are directed at overcoming one or more of the above deficiencies described in the art.

SUMMARY OF THE INVENTION

In accordance with an exemplary embodiment of the present invention, methods and systems are provided for automated platform generation, the systems implement methods comprising selecting a set of platform locations, determining additional platform locations to add to the set of platform locations, and determining an optimum location for each platform location in the set of platform locations.

The systems and methods determine the additional platform locations to add to the set of platforms by adding the additional platform locations to the set and determining whether the additional platform locations are desirable, based on at least a maximum target limit, a drilling distance, and target values associated with the additional platform locations. Targets represent reservoir or drilling locations for drilling wells. The maximum target limit is determined by applying at least one multiplier to approximate an average number of targets to assign to each of the additional platform locations and receiving a user-supplied number of slots for each or the additional platform locations. A target value is a numerical value associated with the distribution of a property of interest associated with a reservoir (such as the distribution of porosity or oil saturation). In addition, the systems and methods may also apply at least one multiplier to approximate an average number of targets to assign, receive user-supplied number of slots, and determine a maximum target limit for each additional platform location.

The systems and methods, in accordance with the present invention, optimize the platform location set by (a) setting a step-out distance equal to a fraction of the platform reach; (b) moving each platform in the set in eight compass directions and, if a new location is better than the original location, moving the platform to the new location; (c) executing step (b) until new locations for each platform are no longer achieved; and (d) executing steps (a) through (c) progressively decreasing the step-out distance until a more desirable set of platforms is no longer achieved. The step-out distance may be reduced by a predetermined amount for each execution of step (d) above.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the exemplary embodiments of the invention, which are illustrated in the accompanying drawings. Wherever possible, the same reference numbers will be used throughout the drawings to refer to the same or like parts.

System Architecture

Figure 1:
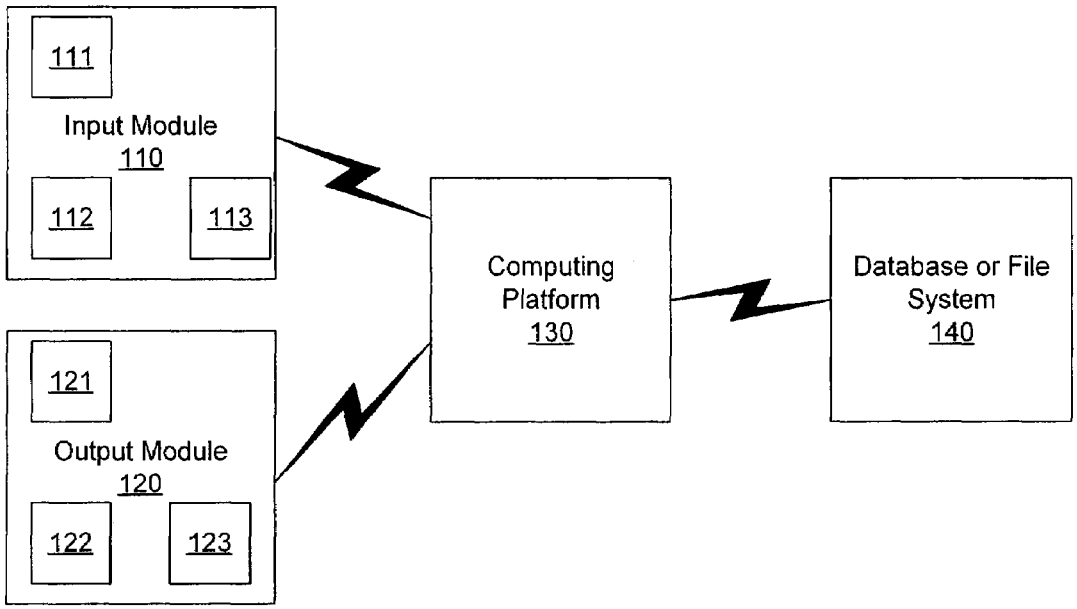
FIG. 1 is a system environment in accordance with principles of the present invention.

By way of a non-limiting example, FIG. 1 illustrates a computer system in which the features and principles of the present invention may be implemented. As illustrated in the block diagram of FIG. 1, a system environment consistent with an embodiment of the present invention may include an input module 110, an output module 120, a computing platform 130, and a database or file system 140. Computing platform 130 is adapted to include the necessary functionality and computing capabilities to implement the automated target selection and platform generation methodology through the associated components (input module 110, output module 120, and database or file system 140).

In the embodiment of FIG. 1, computing platform 130 may comprise a PC or PDA for performing various functions and operations of the invention. Computing platform 130 may be implemented, for example, by a general purpose computer selectively activated or reconfigured by a computer program stored in the computer, or may be a specially constructed computing platform for carrying out the features and operations of the present invention. Computing platform 130 may also be implemented or provided with a wide variety of components or subsystems including, for example, one or more of the following: one or more central processing units, a co-processor, memory, registers, and other data processing devices and subsystems. Computing platform 130 also communicates or transfers dynamic analysis input and output to and from input module 110 and output module 120 through the use of direct connections or communication links, as illustrated in FIG. 1.

Alternatively, communication between computing platform 130 and modules 110, 120 can be achieved through the use of a network architecture (not shown). In the alternative embodiment (not shown), the network architecture may comprise, alone, or in any suitable combination, a telephone-based network (such as a PBX or POTS), a local area network (LAN), a wide area network (WAN), a dedicated intranet, and/or the Internet. Further, it may comprise any suitable combination of wired and/or wireless components and systems. By using dedicated communication links or shared network architecture, computing platform 130 may be located in the same location or at a geographically distant location from input module 110 and/or output module 120.

Input module 110 of the system environment shown in FIG. 1 may be implemented with a wide variety of devices to receive and/or provide the data as input to computing platform 130. As illustrated in FIG. 1, input module 110 includes an input device 111, a storage device 112, and/or a network 113. Input device 111 may include a keyboard, a mouse, a disk drive, video camera, magnetic card reader, or any other suitable input device for providing customer information to computing platform 130. Memory device may be implemented with various forms of memory or storage devices, such as read-only memory (ROM) devices and random access memory (RAM) devices. Storage device 112 may include a memory tape or disk drive for reading and providing information on a storage tape or disk as input to computing platform 120. Input module 110 may also include network interface 113, as illustrated in FIG. 1, to receive data over a network (such as a LAN, WAN, intranet or the Internet) and to provide the same as input to computing platform 130. For example, network interface 113 may be connected to a public or private database over a network for the purpose of receiving information about the customers from computing platform 130.

As illustrated in FIG. 1, output module 120 includes a display adapter 121, a printer device adapter 122, and/or a network interface 123 for receiving the results provided as output from computing module 120. The output from computing platform 130 may be displayed or viewed through display adapter 121 (such as a CRT or LCD) and printer device adapter 122. If needed, network interface 123 may also be provided to facilitate the communication of the results from computer platform 130 over a network (such as a LAN, WAN, intranet or the Internet) to remote or distant locations for further analysis or viewing.

Automated Platform Generation

Operational Description

In methods consistent with the present invention, a first step in generating platforms for a set of drilling targets may be to derive a set of possible locations. One method consistent with the invention may use three methods to arrive at the possible platform locations. A first method may be to use the actual X and Y coordinates of each target developed using the methodology of an automatic target selection method described in U.S. patent application Ser. No. 10/622,976, filed on Jul. 18, 2003, now issued as U.S. Pat. No. 7,096,172, on Aug. 22, 2006 which is herein incorporated by reference, as the potential surface locations. However, it is important to note that the exemplary automatic target selection method of U.S. patent application Ser. No. 10/622,976, now issued as U.S. Pat. No. 7,096,172 may compliment, but is not required by, the exemplary automated platform selection method consistent with the present invention.

A second method may be to select from user-specified locations. This method may be helpful when there are a limited number of locations that could potentially be used due to geographic considerations. A third method may be to create a grid of regularly spaced points that cover a geographic range of the targets. This method may be used when there is either a very large (e.g., >100 targets) or very small (e.g., <10 targets) number of targets. This method may also be used when many of the target locations are invalidated by a validate platform location method.

The validate platform location method may be used to test whether a potential platform location, either in the initial generation of possible locations or during future optimization, may be in a geographically valid area. To determine whether the platform location is valid, the method compares the location of the platform in two-dimensions against a set of exclusionary polygons. If the location is inside one of the polygons, it may be considered to be an invalid location. This method may take into account trenches, fairways, pipelines, shallow hazards, environmentally sensitive areas, shipwrecks, and other obstacles.

Once a set of possible locations has been established, one of two methods may be used to produce the platform locations. A first method (find best new location) selects the best location from among the possible locations and a second method (optimize locations) adjusts the positions of all of the selected locations to try to improve them. Since there are several modes in which this can be used, there are different sequences for employing these methods.

In one exemplary mode, if the user selection method of arriving at the platform locations is used, the optimize locations method may not be invoked. In another exemplary mode, if the user attempts to create a set number of platforms, the find best new location method may be used once for each platform that is desired, then the optimize locations method may be used to improve those locations. In yet another exemplary mode, if the user attempts to generate platforms to reach a certain percentage of the targets, the find best new location and optimize locations methods may be alternatively invoked, until the specified number of platforms have been generated to reach the desired number of targets.

Both the find best new location method and optimize locations method may use a sub-method (count reachable targets), which may determine for a given set of platforms the number of targets that may be reached and the total distance to reach each of the targets. The total distance may be defined as the sum of the lateral distances between the targets and a platform location. The total distance may be used to resolve ties between platform sets. For example, if platform set A and platform set B can each reach 52 targets, but the total distance for set A is 130,000 feet and the total distance for set B is 110,000 feet; then platform set B may be the most desirable selection since it requires less drilling to reach the same number of targets.

The count reachable targets sub-method may also use one or more multipliers to approximate the average number of targets per well based on the type of wells that may be drilled. From these multiplier(s) and a user-supplied number of slots, the sub-method determines the maximum target limit per platform and only allocates up to that maximum to each platform. The count reachable targets sub-method may also take into account the value associated with the targets associated with each platform in determining the best set of possible platforms. If the targets are selected using the actual X and Y coordinates of the automated target selection method described above, the values used in the target selection method may be imported into the count reachable targets sub-method. It should by understood that each target represents a reservoir or drilling location for drilling a well and that the targets may be associated with a numerical value associated with the distribution of a property of interest associated with a reservoir (such as the distribution of porosity or oil saturation). The count reachable targets sub-method may take into account any hazards (shallow gas, faults, etc.) existing between a possible platform location and a given target. If any hazards stand between the two in 3 dimensions, that target may not be counted for that location, in addition to any surface hazards that may invalidate the location initially. The count reachable targets sub-method may also, if the user indicates, take into account a range of drilling directions, only counting those targets whose azimuthal angle to the location is within a user-determined range, allowing for greater borehole stability.

The find best new location method may start by executing the count reachable targets sub-method using the platforms that have already been calculated from one of the platform selection methods described above. The method then tests each possible, but unused, location by adding the platform location to the list of platforms and re-executing the count reachable targets sub-method. One platform location is considered better than another if the inclusion of the platform in the list causes the total set of platforms to either reach more targets, reach the same number of targets with less total distance, or reach a number of targets that have a higher cumulative value. Based on the above criteria, the find best location method returns the most desirable platform locations.

The optimize locations method makes one or more passes through the set of platform locations, altering one location at a time. The first pass is made with a step size of, for example, ½ the platform reach. The platform reach is a user-supplied parameter indicating the horizontal distance that a well may extend from the platform center. The method tests the platform locations in the eight compass point directions around the current location, moving the step size in the X and Y directions. Each of the new platform locations are validated by the validate platform location method and then tested by using the count reachable targets method. If one of the new eight locations is better than the original, the platform is moved to that location and the process is repeated. When none of the eight locations produces a better result, the method moves to the next platform. When all of the platforms have been adjusted, the step size is decreased by a pre-determined amount (e.g., 10%) and the platform relocation process described above is repeated. When a decrease in the step size does not produce a better result, the optimize location method terminates and provides the optimized locations for the platforms.

Figure 2:
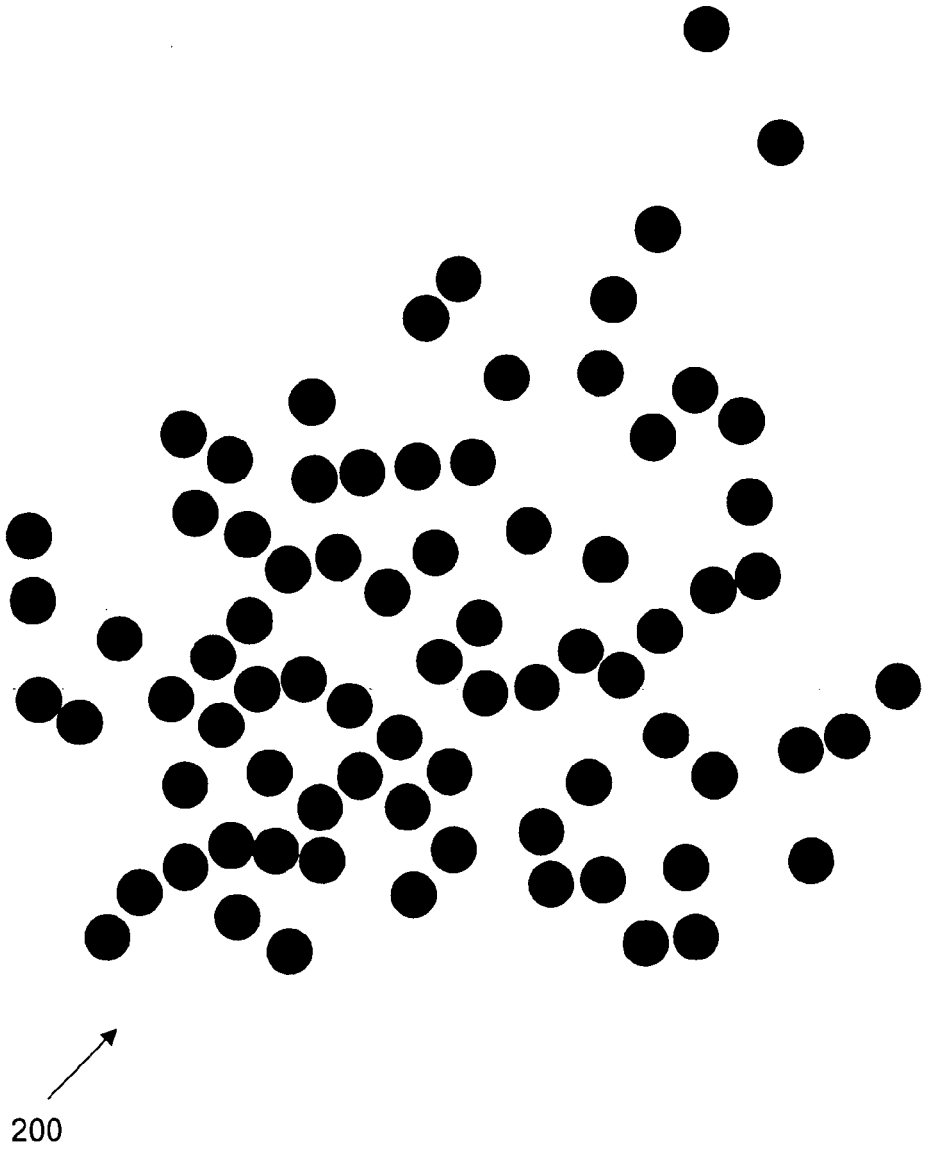
FIG. 2 is an exemplary pictorial illustration of a number of targets that may be serviced using a platform generation methodology in accordance with the principles of the present invention.
Figure 3:
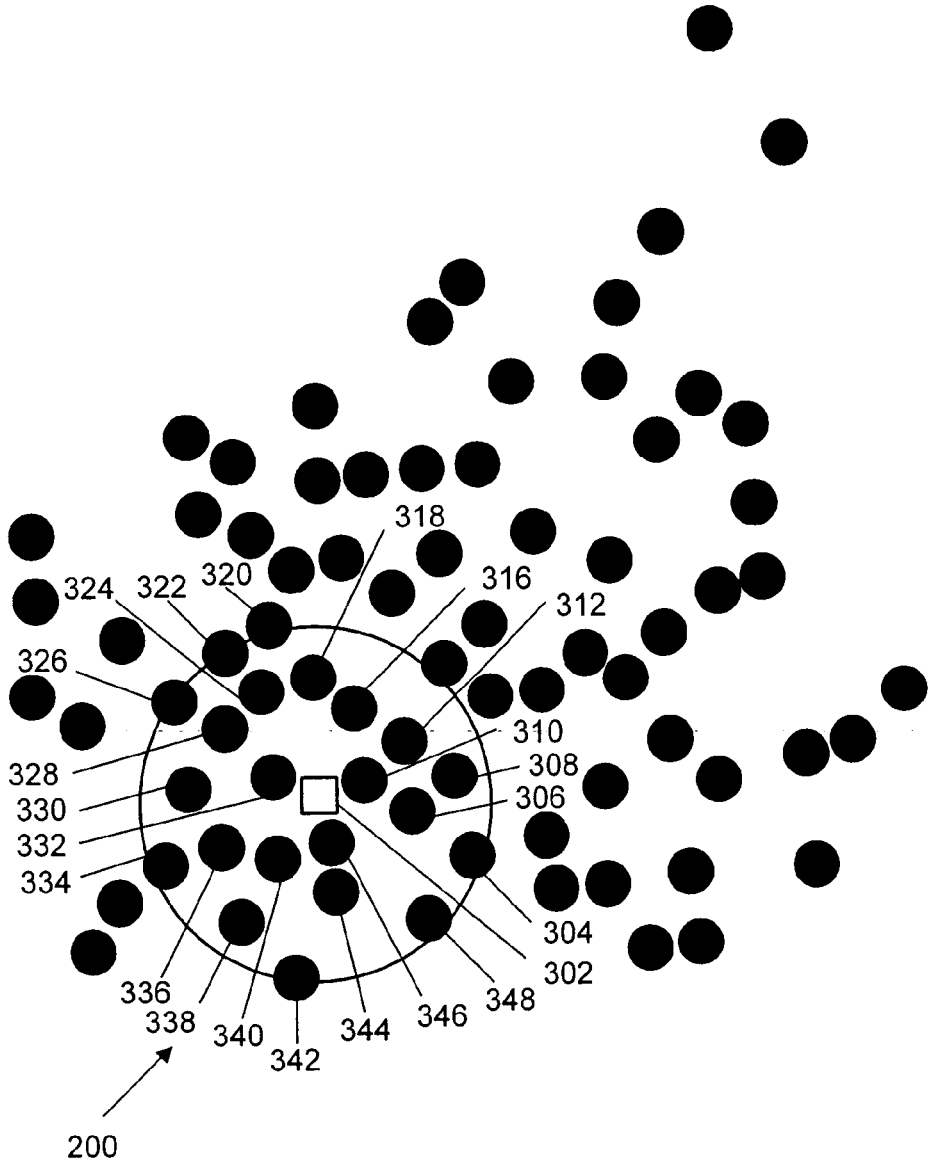
FIG. 3 illustrates an exemplary first platform location and the targets that may be serviced in accordance with the principles of the present invention.

FIGS. 2–13 provide an exemplary pictorial illustration of the above platform generation methodology. FIG. 2 illustrates a number of targets (200) that are to be serviced by platforms located using the platform generation methodology of one embodiment of the present invention. FIG. 3 illustrates the location of a first platform location 302 and twenty-two targets (304–348) that may be serviced from platform location 302. Platform 302 may be selected using one of the above described platform location methods.

Figure 4:
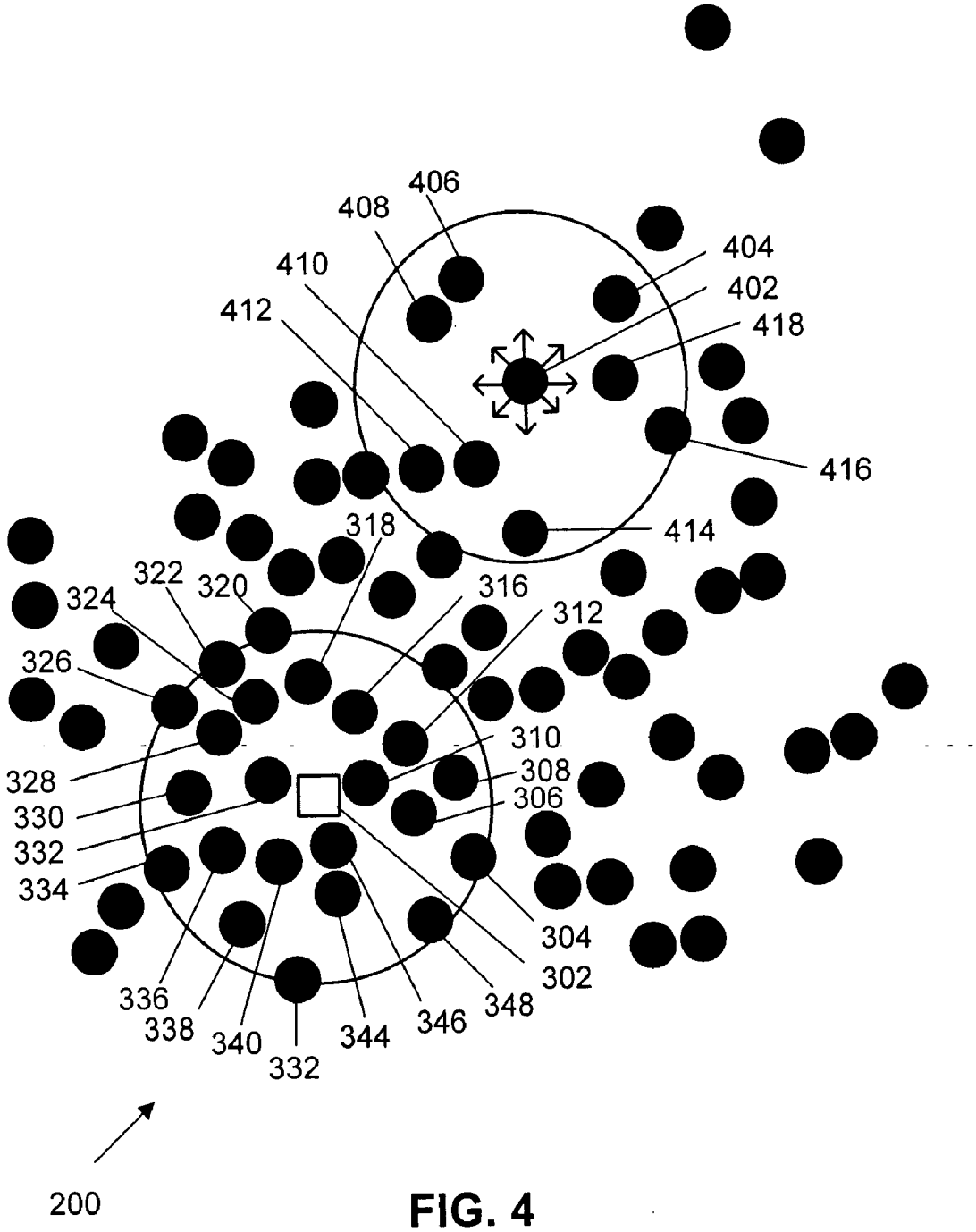
FIG. 4 illustrates an exemplary second platform location and the targets that may be serviced in accordance with the principles of the present invention.

FIG. 4 illustrates a second platform location 402 and nine targets (402–416). Second platform 402 is located over one of the nine targets. The combination of platform location 302 and 402 may reach a total of thirty-one targets (22 from platform location 302 and 9 from platform location 402). A target may be determined to be within the reach of a platform location if the center of the target is within the illustrated circle or platform reach.

In FIG. 4, the arrows about second platform location 402 indicate the eight compass point directions in which one embodiment of the platform generation method tests platform locations around the initial platform location to determine the optimum platform location. Each of the new platform locations are validated by the validate platform location method and then tested by using the count reachable targets method.

Figure 5:
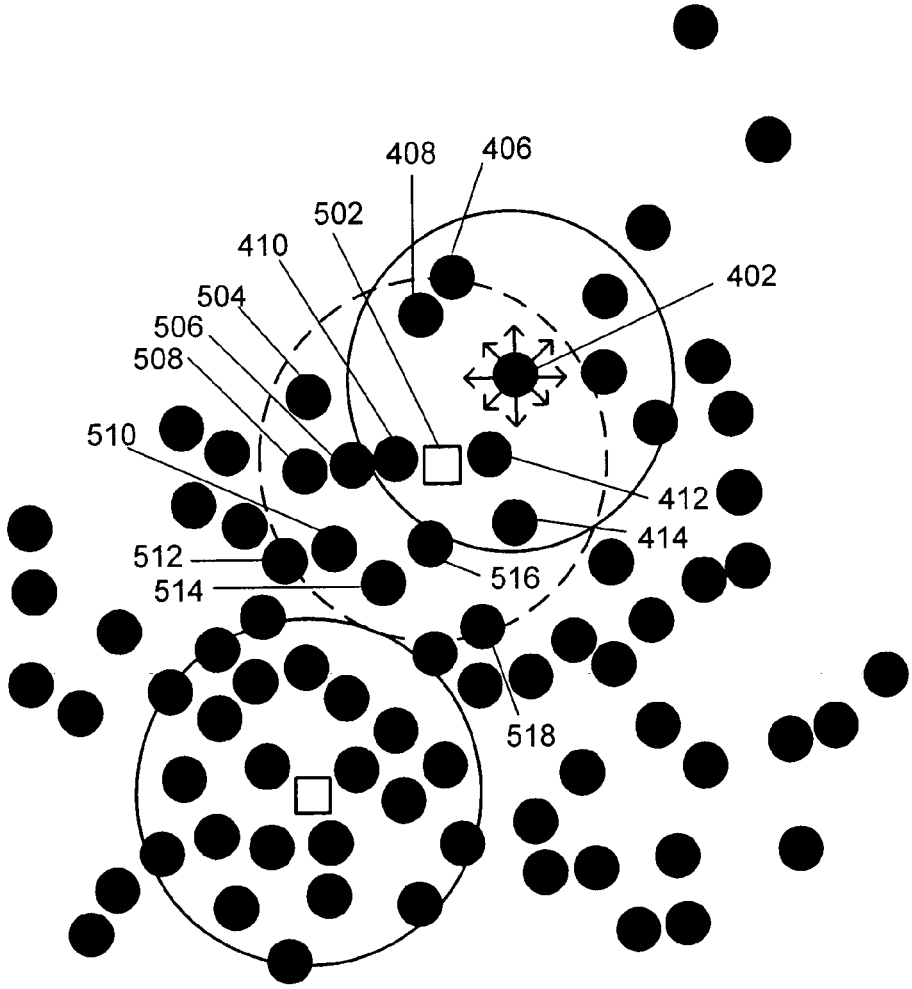
FIG. 5 illustrates an exemplary new location for a second platform location in accordance with the principles of the present invention.

FIG. 5 illustrates one of the possible new locations for second platform location 402. New platform location 502 is an alternate location to the southwest of the original location of second platform 402. The new combination of first platform 302 and new platform location 502 may reach a total of 36 targets (22 from first platform location 302 and 14 from new platform location 502) (304–348, 402, 406–414, and 504–518). If new platform location 502 is determined to be a better location than second platform location 402 and any of the seven compass point locations tested, the platform is moved to new platform location 502 and the process is repeated. When none of the eight locations produces a better result, the method moves to the next platform location.

Figure 6:
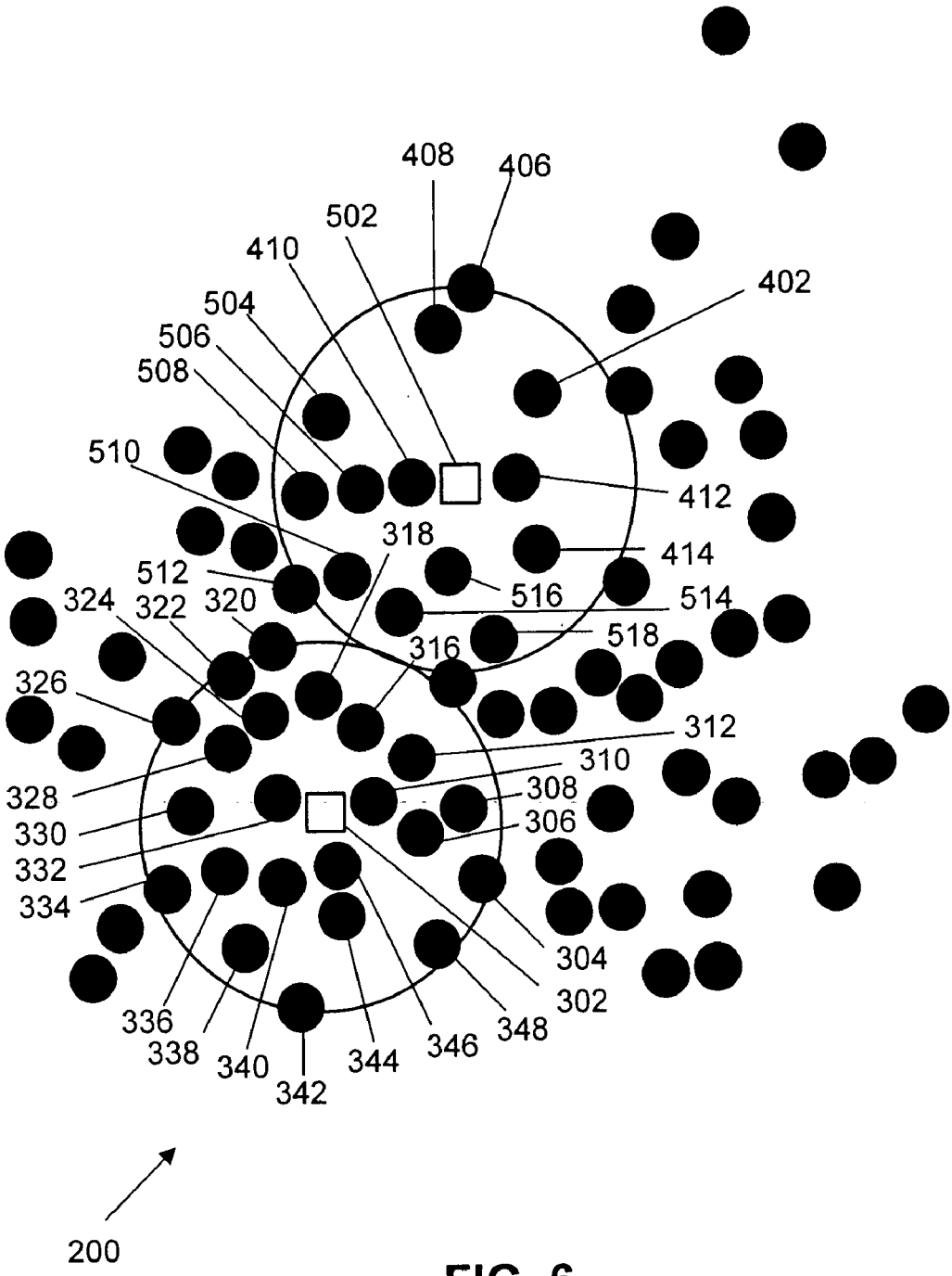
FIG. 6 is an exemplary pictorial of the targets that can be serviced from a first platform and the new location of a second platform in accordance with the principles of the present invention.

FIG. 6 illustrates the selection of new platform location 502 as a better location for second platform location 402. FIG. 6 also illustrates the targets that may be reached from first platform 302 and new platform 502 (304–348, 402, 406–414, and 504–518).

When all of the platforms have been adjusted, in the manner discussed above, the step size may be decreased by an amount (e.g., 10%) and the platform relocation process described above may be repeated. When a decrease in the step size does not produce a better result, the optimize location method terminates and provides the optimized locations for the platforms.

Figure 7:
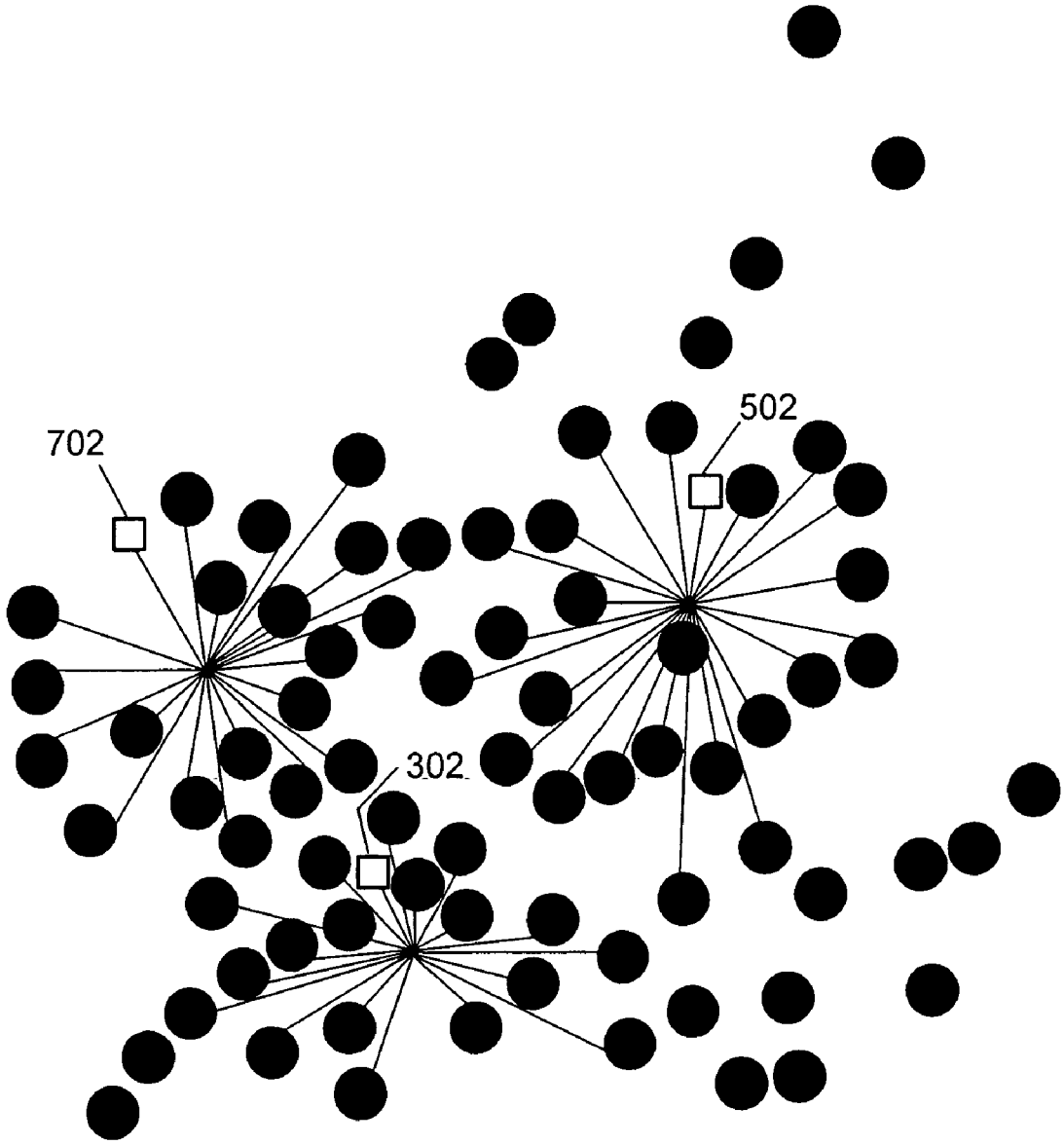
FIG. 7 illustrates an exemplary set of platform locations developed in accordance with the principles of the present invention.

FIG. 7 illustrates an exemplary set of platform locations developed using the method described above. The optimum platform locations are identified at 302, 502, and 702.

Methodology

Figure 8:
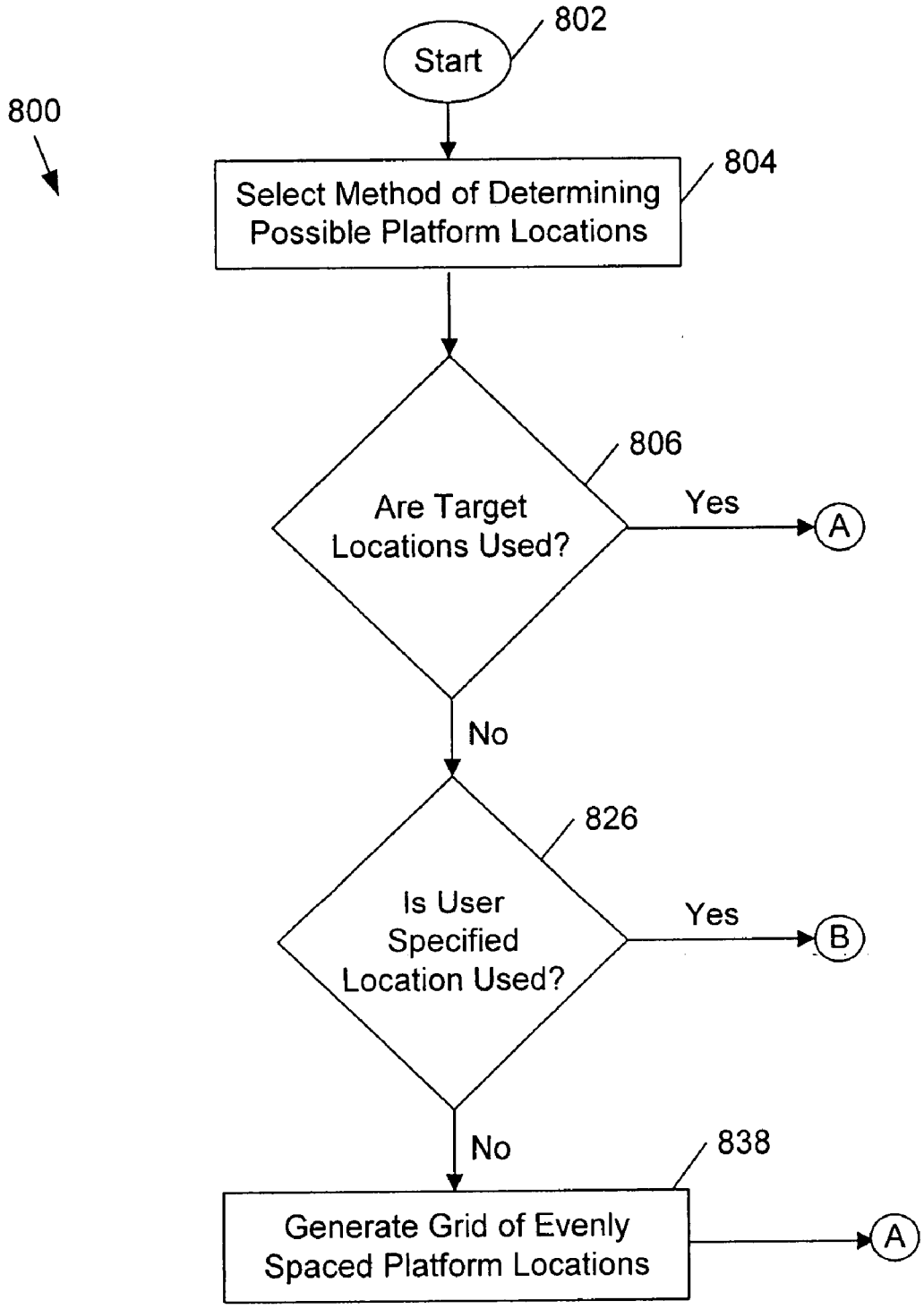
FIGS. 8–10 are flow charts illustrating an exemplary method for selecting and optimizing platform generation in accordance with the principles of the present invention.
Figure 9:
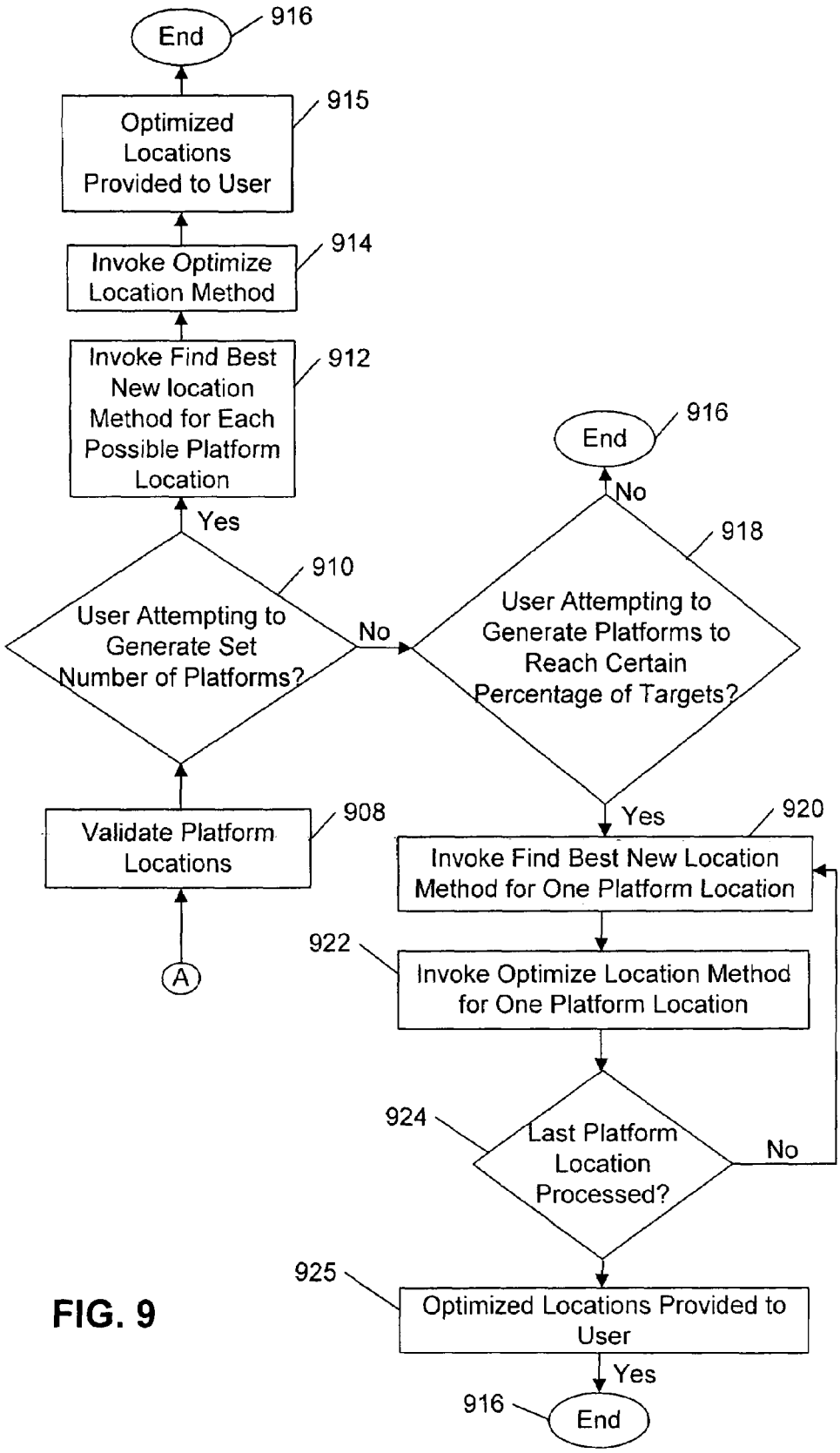
Figure 10:
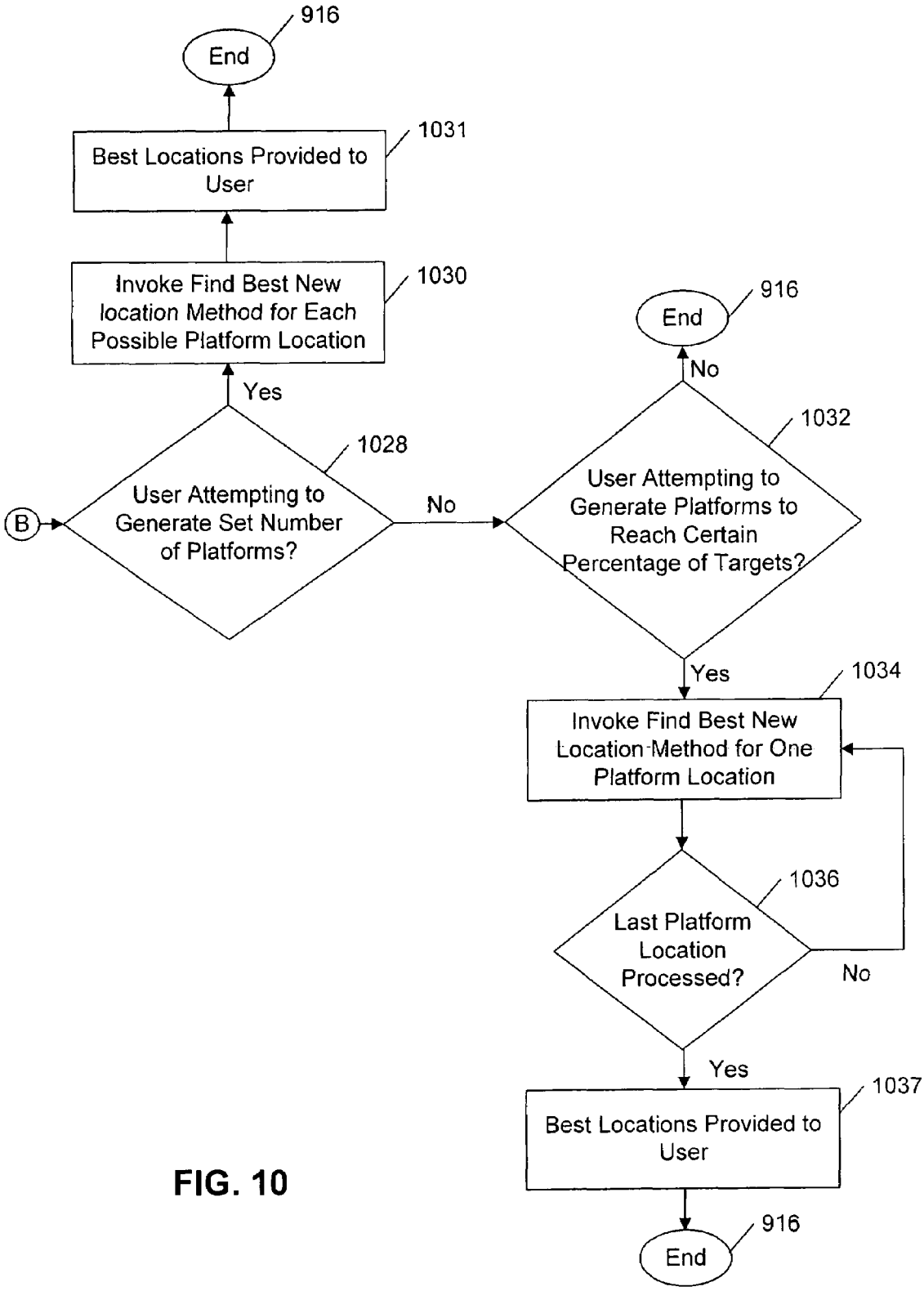

FIGS. 8–10 are flowcharts illustrating the exemplary methods for selecting targets and optimizing platform generation consistent with the present invention. Method 800 starts (Stage 802) and proceeds to Stage 804. In Stage 804, the user selects the method for selecting one or more possible platform locations. If the user selects the targets generated with the automated target selection method described in U.S. patent application Ser. No. 10/622,976, now issued as U.S. Pat. No. 7,096,172 the actual X and Y coordinates of each target selected may be used as the potential surface locations for the platforms. (Stage 806) It is important to note that the exemplary automatic target selection method of U.S. patent application Ser. No. 10/622,976, now issued as U.S. Pat. No. 7,096,172 may compliment, but is not required by, the exemplary automated platform generation method of this embodiment of the present invention.

Once the surface target locations are specified, method 800 validates the platform locations (Stage 908 (refer to FIG. 9)) and determines whether the user is attempting to generate a set number of platforms. (Stage 910) If this is the case, method 800 then invokes the find best new location method for each possible platform location (Stage 912); and, once the best new locations are determined and the method terminates, the optimized location method (Stage 914) is invoked. When the optimize location method has optimized the platform locations, the optimized locations are provided to the user (Stage 915), and method 800 ends. (Stage 916)

If, however, method 800 determined that the user is not attempting to generate a set number of platforms, method 800 determines if the user is attempting to generate platforms to reach a certain percentage of the targets. (Stage 918) If this is not the case, method 800 ends. (Stage 916) If, however, this is the case, method 800 proceeds to invoke the find best new location method and the optimize location method for one location. (Stages 920 and 922)

Then, method 800 determines if the last platform location has been processed. If this is the case, the optimized locations are provided to the user (Stage 925), and method 800 ends. (Stage 916) If this not the case, method 800 loops back to Stages 920 and 922 and again executes the find best location method and the optimize location method. Method 800 remains in this loop until the last platform location has been processed; then method 800 ends. (Stage 916)

Returning to Stage 806 (refer to FIG. 8), if at Stage 806, the user did not use the target locations generated with the automated target selection method and the user selects to specify the platform locations (Stage 826), then method 800 determines whether the user is attempting to generate a set number of platforms. (Stage 1028 (refer to FIG. 10)) If this is the case, method 800 then invokes the find best new location method for each possible platform location (Stage 1030); and when all possible platform locations have been processed, the best locations are provided to the user (Stage 1031), and method 800 ends. (Stage 916)

If, however, method 800 determined that the user is not attempting to generate a set number of platforms, method 800 determines if the user is attempting to generate platforms to reach a certain percentage of the targets. (Stage 1032) If this is not the case, method 800 ends. (Stage 916) If, however, this is the case, method 800 proceeds to invoke the find best new location method for one location. (Stages 1034 and 1036)

Then, method 800 determines if the last platform location has been processed. (Stage 1036) If this is the case, method 800 ends. (Stage 916) If this not the case, method 800 loops back to Stages 1034 and 1036 and again executes the find best location method. Method 800 remains in this loop until the last platform location has been processed; then method 800 ends. (Stage 916)

If at Stage 826 (refer to FIG. 8), the user did not select the targets, method 800 proceeds to generate a grid of evenly spaced platform locations (Stage 838) and execute the stages in FIG. 9 described above in connection with the use of the targets selected using the automated target selection method disclosed in U.S. patent application Ser. No. 10/622,976, now issued as U.S. Pat. No. 7,096,172.

Figure 11:
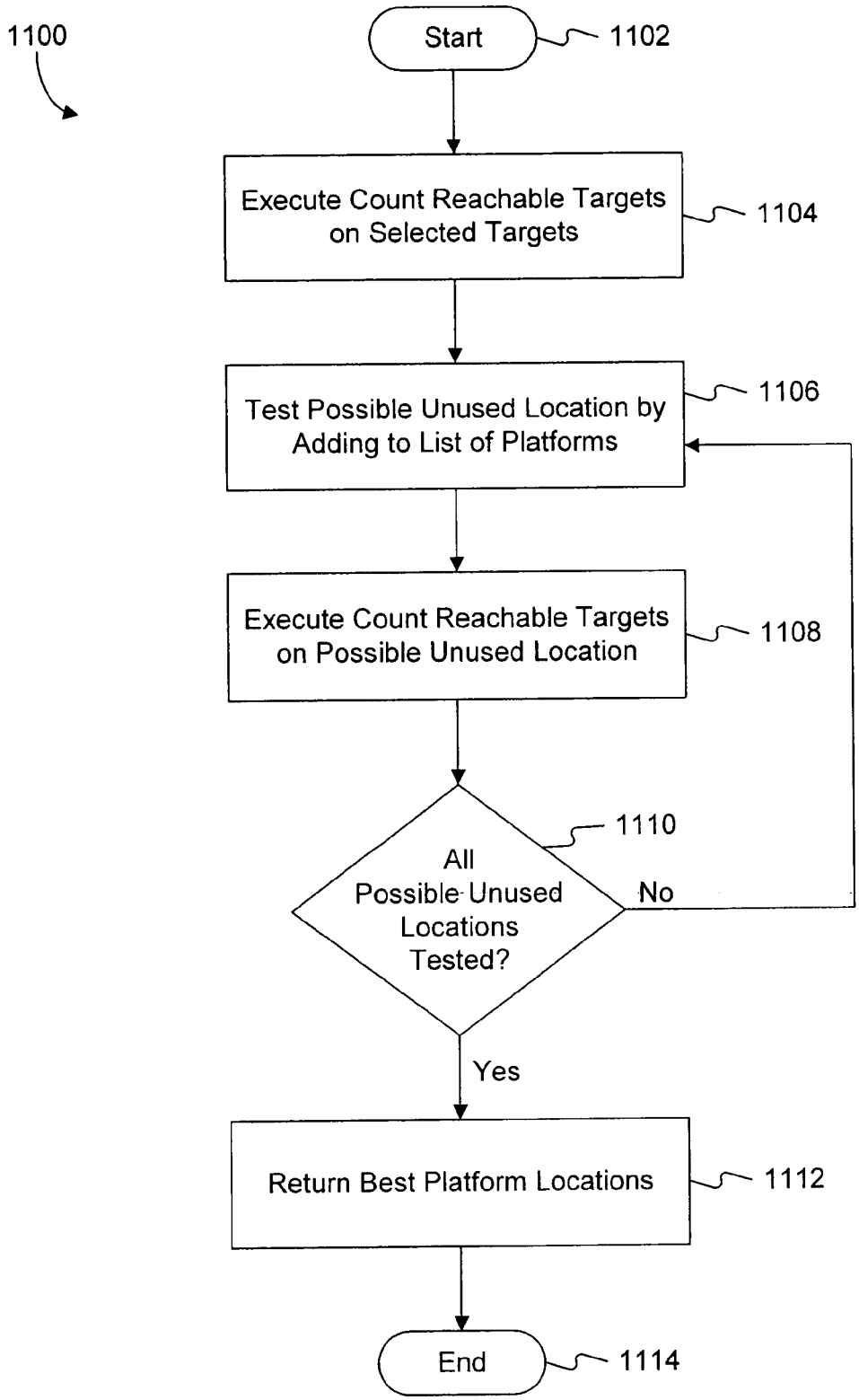
FIG. 11 is a flow chart illustrating an exemplary "find best new location" method in accordance with the principles of the present invention.

FIG. 11 illustrates a flowchart of the exemplary find best new location method. Method 1100 starts (Stage 1102) and proceeds to Stage 1104. In Stage 1104, method 1100 executes the count reachable targets sub-method on the user selected targets or the targets selected using the automated target selection method described above. The count reachable targets method is described below in conjunction with FIG. 12.

Next, method 1100 tests each possible, but unused, location by adding the platform location to the list of platforms (Stage 1106) and re-executing the count reachable targets sub-method. (Stage 1108) When Stage 1108 is completed, method 1100 tests whether all the possible unused locations have been tested. If all the unused locations have been tested, method 1100 returns the best platform locations and ends. (Stages 1112 and 1114).

However, if at Stage 1110 method 1100 determines that all unused locations have not been tested, method 1100 returns to Stage 1106 and adds another platform location to the list and re-executes the count reachable targets sub-method. (Stage 1108). Then, method 1100 again determines whether all the unused locations have been tested. (Stage 1110) Until all unused locations have been tested, method 1100 remains in this loop. When all unused locations have been tested, method 1100 returns the best platform locations and ends. (Stages 1112 and 1114)

Figure 12:
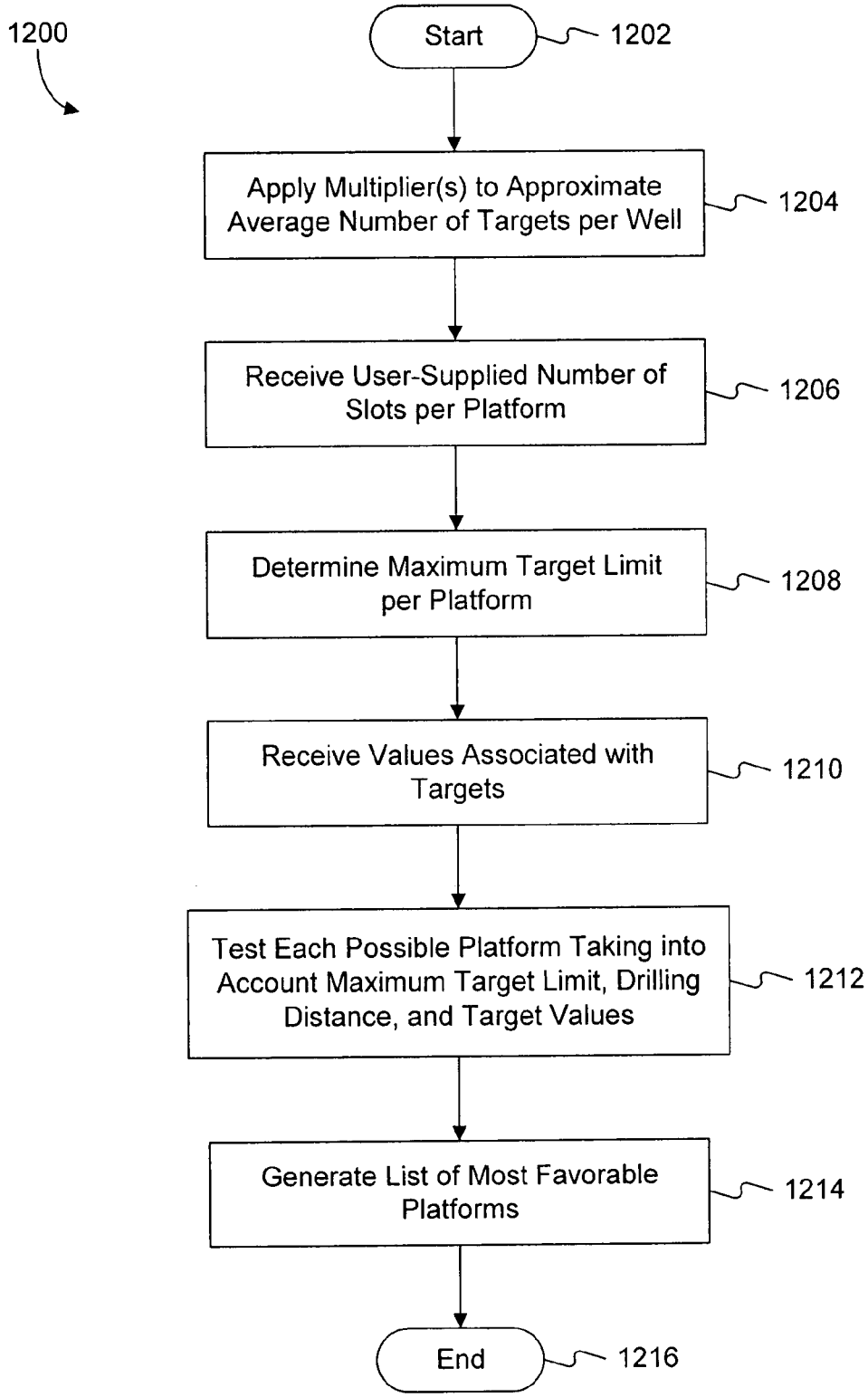
FIG. 12 is a flow chart illustrating an exemplary "count reachable targets" sub-method in accordance with the principles of the present invention.

FIG. 12 is a flowchart illustrating the exemplary count reachable targets sub-method 1200. The count reachable targets sub-method starts (Stage 1202) and proceeds to apply multiplier(s) to approximate the average number of targets per well based on the type of wells that may be drilled. (Stage 1204) From these multiplier(s) and a user-supplied number of slots (Stage 1206), method 1200 determines the maximum target limit per platform and only allocates up to that maximum to each platform. (Stage 1208) Method 1200 may also take into account the value associated with the targets assigned to each platform in determining the best set of possible platforms. (Stage 1210)

Then, method 1200 tests each possible platform by taking into account the maximum target limit, total drilling distance to the targets, and the target values. (Stage 1212) It should be understood that a maximum target limit represents the maximum number (or count) of drilling locations which are reachable by each possible platform. During the testing stage, one platform location may be considered better than another if the inclusion of the platform in the list causes the total set of platforms to either reach more targets, reach the same number of targets with less total distance, or reach a number of targets that have a higher cumulative value of a property of interest associated with a reservoir (such as the distribution of porosity or oil saturation. Based on the above criteria, method 1200 determines and returns the best platform locations and ends. (Stages 1214 and 1216)

Figure 13:
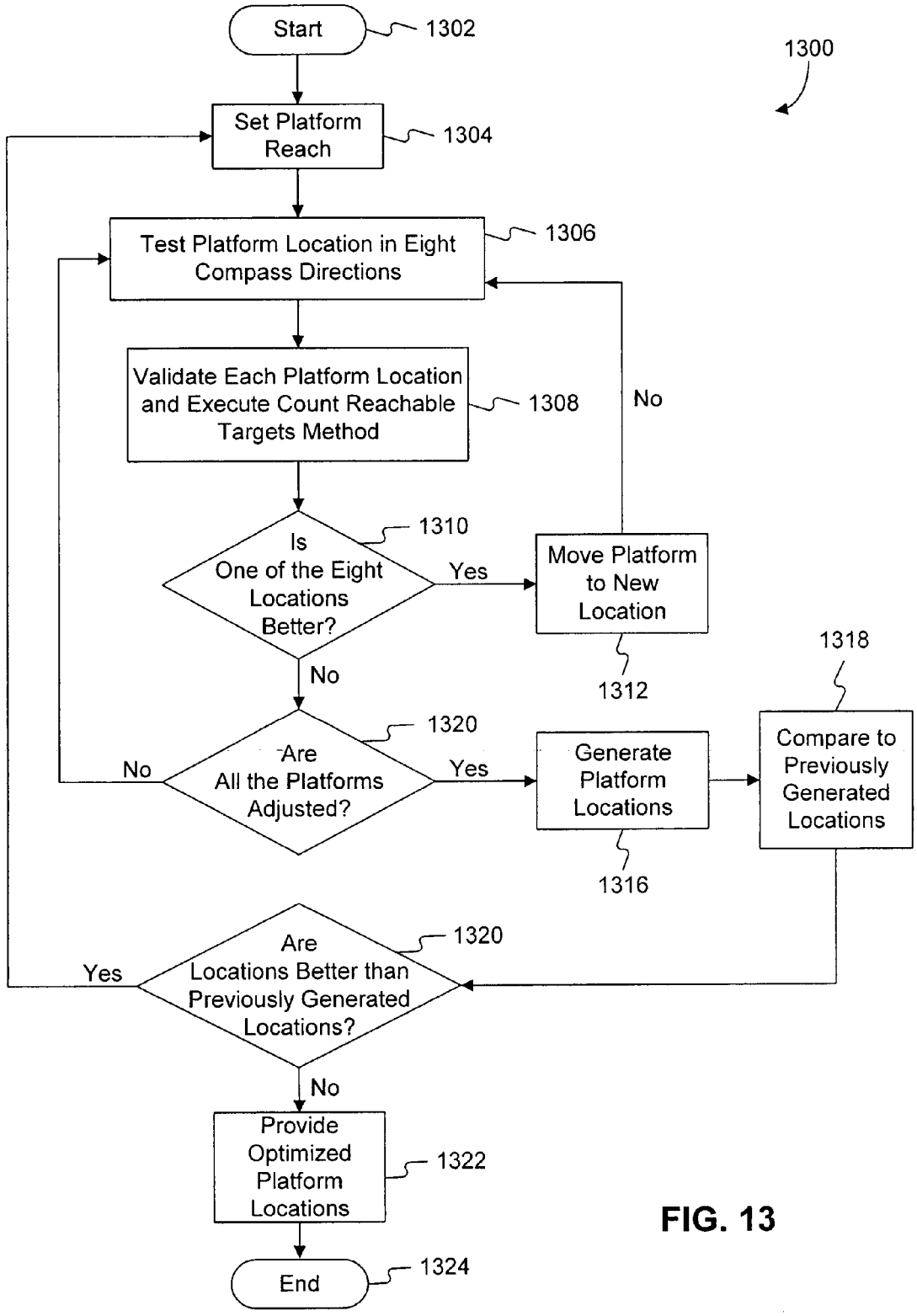
FIG. 13 is a flow chart illustrating an exemplary "optimize location" method in accordance with the principles of the present invention.

FIG. 13 is a flowchart illustrating the exemplary optimize locations method 1300. The optimize locations method 1300 starts (Stage 1302) by setting a platform reach of, for example, one-half. (Stage 1304) Then, the method tests the platform locations in the eight compass point directions around the current location, moving the step size in the X and Y directions. (Stage 1306) Each of the locations that the platform is moved to is validated and then tested by using the count reachable targets method. (Stage 1308) The platform locations are validated by comparing the location of the platform on two-dimensions against a set of exclusionary polygons. If the location is inside of one of the polygons, it may be considered to be an invalid location. The validation may take into account trenches, fairways, and other obstacles.

If one of the new eight locations is better than the original, the platform is moved to that location (Stages 1310 and 1312) and the method loops back to Stages 1306 and 1308 and repeats the relocation, validation, and testing of the platform. When none of the eight locations produces a better result, method 1300 determines if all the platforms have been adjusted. (Stage 1320) If all the platforms have not been adjusted, method 1300 loops back to Stage 1306 and performs all the stages described above for the next platform to determine a better platform location for the remaining platforms.

When all of the platforms have been adjusted, method 1300 generates a set of platform locations and compares them to the previously generated set. (Stages 1316 and 1318) Of course, no comparison is made in the first execution of the method. If the current location set is less desirable than the previous location set, method 1300 provides the previous location set as the optimized platform locations and ends. (Stages 1322–1324) However, if the current location set is more desirable than the previous location set, method 1300 loops back to Stage 1304 and re-executes the above described stages using a new platform reach. The platform reach may be decreased by a pre-determined amount (e.g., 10%). When a decrease in platform reach or step size does not produce a better result (Stage 1320), the optimize location method terminates and provides the optimized locations of the platforms. (Stages 1322 and 1324)

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A computer-implemented method of generating optimized platform locations for extracting hydrocarbons from underground reservoirs, comprising:

computing a maximum number of targets to be assigned for each of a user-specified number of platforms by determining the product of a user-specified number of slots and a user-specified number of targets per slot;

selecting a possible set of platform locations from at least one of a number of X and Y coordinates from automatically generated target locations, a user-specified number of platform locations, or a generated grid of evenly spaced platform locations;

validating the set of possible platform locations to determine that each possible platform location in the set is in a geographically valid area by comparing each possible platform location against a set of exclusionary polygons;

determining a best set of platform locations from the set of possible platform locations by an iterative process which adds each of the possible platform locations to a list comprising the pre-selected number of platforms and determining if the inclusion of each one of the possible platform locations in the list causes the total set of platforms to reach more targets or the same number of targets with less total distance thereby returning locations that are most desirable; and optimizing each platform location in the best set of platform locations by an iterative process which determines whether an improvement is achieved by moving each of the platform locations within a fraction of a platform reach in eight compass directions around a current selected best platform location.

2. The method of claim 1, wherein optimizing each platform location includes:

(a) setting an initial step-out distance equal to the fraction of the platform reach;

(b) selecting a potential new platform location located the step-out distance from the original platform location in one of the eight compass directions;

(c) validating the potential new platform location;

(d) computing at least one of the number of targets that could be reached from the potential new platform location or the total drilling distance to reach all the targets to be reached from the potential new platform location;

(e) comparing the computed number of targets that could be reached from the potential new platform location or the total drilling distance to reach all the targets to be reached from the potential new platform location against the values at the original platform location;

(f) determining that the potential new platform location is better than the original location based on at least one of the following: more targets may be reached from the potential new platform location than from the original platform location and the same number of targets may be reached from the potential new platform location with less drilling distance than from the original platform location;

(g) moving the original platform location to the potential new platform location; and (h) executing steps (b) to (g) for other compass directions; and (i) executing steps (b) through (h) by progressively decreasing the step-out distance until a more desirable platform location is no longer achieved.

3. The method of claims 2, wherein the initial step-out distance is reduced by a predetermined amount for each execution of step (i).

4. A computer-readable medium having computer-executable instructions which when executed on a computer perform a process for generating optimized platform locations for extracting hydrocarbons from underground reservoirs, the process comprising:

computing a maximum number of targets to be assigned for each of a user-specified number of platforms by determining the product of a user-specified number of slots and a user-specified number of targets per slot;

selecting a possible set of platform locations from at least one of a number of X and Y coordinates from automatically generated target locations, a user-specified number of platform locations, or a generated grid of evenly spaced platform locations;

validating the set of possible platform locations to determine that each possible platform location in the set is in a geographically valid area by comparing each possible platform location against a set of exclusionary polygons;

determining a best set of platform locations from the set of possible platform locations by an iterative process which adds each of the possible platform locations to a list comprising the pre-selected number of platforms and determining if the inclusion of each one of the possible platform locations in the list causes the total set of platforms to reach more targets or the same number of targets with less total distance; and optimizing each platform location in the best set of platform locations by an iterative process which determines whether an improvement is achieved by moving each of the platform locations within a fraction of a platform reach in eight compass directions around a current selected best platform location.

5. The computer-readable medium of claim 4, wherein optimizing each platform location includes:

(a) setting an initial step-out distance equal to the fraction of the platform reach;

(b) selecting a potential new platform location located the step-out distance from the original platform location in one of the eight compass directions;

(c) validating the potential new platform location;

(d) computing at least one of the number of targets that could be reached from the potential new platform location or the total drilling distance to reach all the targets to be reached from the potential new platform location;

(e) comparing the computed number of targets that could be reached from the potential new platform location or the total drilling distance to reach all the targets to be reached from the potential new platform location against the values at the original platform location;

(f) determining that the potential new platform location is better than the original location based on at least one of the following; more targets may be reached from the potential new platform location than from the original platform location and the same number of targets may be reached from the potential new platform location with less drilling distance than from the original platform location;

(g) moving the original platform location to the potential new platform location;

(h) executing steps (b) to (g) for other compass directions; and (i) executing steps (b) through (h) by progressively decreasing the step-out distance until a more desirable platform location is no longer achieved.

6. The computer-readable medium of claim 5, wherein the initial step-out distance is reduced by a predetermined amount for each execution of step (i).

* * * * *